United States Patent [19]

Borgeas

[11] 3,990,159

[45] Nov. 9, 1976

[54] THERAPEUTIC PERSONALIZABLE HEALTH SHOE

[76] Inventor: Alexander T. Borgeas, 129 W. Catalina Drive, Phoenix, Ariz. 85013

[22] Filed: Aug. 1, 1975

[21] Appl. No.: 601,333

[52] U.S. Cl. ..... 36/101; 36/28

[51] Int. Cl.[2] ..... A43B 3/24; A43B 13/18

[58] Field of Search ..... 36/28, 43, 71, 2.5 R, 36/32 R, 44, 2.5 C, 2.5 W, 100, 101; 2/DIG. 6

[56] References Cited

UNITED STATES PATENTS

| | | | |
|---|---|---|---|
| 2,200,080 | 5/1940 | Fein | 36/2.5 W |
| 2,581,864 | 1/1952 | Kaufmann | 36/43 |
| 2,598,217 | 5/1952 | Bronson | 36/28 |
| 2,678,506 | 5/1954 | Boroumes | 36/28 |

FOREIGN PATENTS OR APPLICATIONS

| | | | |
|---|---|---|---|
| 1,327,141 | 4/1963 | France | 36/2.5 W |

*Primary Examiner*—Patrick D. Lawson
*Attorney, Agent, or Firm*—Warren F. B. Lindsley

[57] ABSTRACT

A new therapeutic health shoe which can be personalized to fit the needs of the user by altering walking patterns by means of transferring the weight of the wearer from one part of the foot to another thereby affecting the angle of the foot with the angle of the leg and modified to reflect the changing conditions of the user's foot.

8 Claims, 19 Drawing Figures

THERAPEUTIC PERSONALIZABLE HEALTH SHOE

BACKGROUND OF THE INVENTION

This invention relates to footwear for controlling the movement of the foot/leg muscles and joints, and more particularly to footwear so constructed and arranged to satisfy the orthopedic foot requirements of the user, thereby resulting in foot comfort of the user whether walking or standing, and modifiable to reflect the changing conditions of the foot.

FIELD OF THE INVENTION

There are many known shoes and sandals adapted for implementing different requirement for supporting the foot. This is usually accomplished by forming the supporting surface of the foot in a suitable manner.

Such footwear has a fixed supporting surface which merely provides a given gripping action of the toes or a given elevation of the heel which in many instances involves an unfavorable movement of the leg and knee. The known soles are often provided with a support for the whole arch of the foot, and this support is maintained when the muscles of the foot at the arch are tightened, thereby preventing the muscles from working freely and changing with time to accommodate the dynamic changes of the foot.

For therapeutic reasons, the role of the shoe should change with time to accomodate the ever changing conditions of the feet and legs of the wearer thus reducing fatique during walking and standing activities.

DESCRIPTION OF THE PRIOR ART

Footwear commonly known as the "earth shoe" and others prevents the toe of the treading foot from swinging outwardly in relation to the heel and is intended to simulate the walking conditions of primitive people moving on soft ground by people today walking on a hard, flat surface.

Much pain in the muscles of the back and legs may be ascribed to an abnormal movement of the leg during walking and abnormal tread of the foot on its supporting surface. By a health improving movement of the leg and a suitable ever changing tread it will be possible to relieve much of this pain and the muscles of foot and leg will be strengthened. The earth shoe merely provides a recessed heel and a curved or rocker surface on the bottom of the shoe extending from a rectilinear generatrix which emanates from a point lying beneath the rear part of the location of the treading surface of the little toe obliquely rearwardly forming an angle of about 70° to 90° with a connecting line which extends from the point of the extreme part of the heel.

This form of footwear causes the foot during walking to shift the pressure on the ball of the foot onto the treading surface of the big toe instead of on the treading surface of the remaining four toes, thus allegedly providing a safer and less tiring walk.

As evident from the above discussion of the earth shoe, the footwear is fixed and does not accommodate changing conditions of the foot for the comfort of the user as to permit the foot and leg of the user to assume its natural position. By being able to change the sole on which the foot rests, it permits the toes of the foot their primitive gripping action thereby releasing the stress on the bottom of the foot taking into consideration the normal torsion-twisting action of the bones which affect foot, leg and thigh positions. If the sole on which the foot rests is a changeable substance, each toe of the foot is permitted its maximum gripping action in the manner of primitive people walking on uneven surfaces even though the wearer is walking on a hard firm surface.

Further, inherited or other acquired deformities of the foot and leg structures of the user must be provided for which the prior art shoes with firm insoles can not provide.

It should be recognized that the earth shoe and others can not be personalized to the user and each shoe heretofore provided must fit either the left or right foot.

SUMMARY OF THE INVENTION

According to the invention claimed, new and improved footwear is provided which is personally adapted to the orthopedic needs of the user and may be periodically modified to fit and serve the changing orthopedic needs of the user. The novel footwear is so designed that its foot supporting sole changes all the time to reflect the standing and walking conditions of the user.

It is, therefore, one object of this invention to provide new and improved footwear which can be built to orthopedically satisfy the needs of a given user by himself, if desirable, and modified without destroying the shoe or its usefulness as the orthopedic needs of that user change.

Another object of this invention is to provide an improved therapeutic health shoe usable for either foot and employing replaceable insoles of various materials which are so shaped to therapeutically treat the user and which may be replaced with other insoles periodically as the needs of the user change.

A further object of this invention is to provide improved footwear adaptable to reflect continuously the changing foot conditions of the user.

A still further object of this invention is to provide an improved therapeutic health shoe built up from a common tread surface to include a particular insole designed to serve the orthopedic needs of the particular user and adaptable for forming into common forms of footwear such as boots, shoes, sandals, wooden shoes or the like.

A still further object of this invention is to provide a new and improved footwear consisting of an insole which may be formed of various materials and modified by the user to change his walking pattern to transfer his weight from one part of the foot to another.

A still further object of this invention is to provide an insole for footwear which may be reversed to cause different walking patterns for stresses and pathological conditions and which may be altered, added to or subtracted from to satisfy the dynamic changing conditions of the foot.

A still further object of this invention is to provide improved footwear which permits the wearer to adjust his walking tread area by changing its thickness and density for better toe traction and for exercising the intrinsic foot muscles.

A still further object of this invention is to provide improved footwear which may be readily varied for each foot to assure normal walking conditions even though congenital or acquired foot deformities such as bunions, contraced and deformed toes, flat feet or high arched feet are involved.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWING

The present invention may be more readily described by reference to the accompanying drawing in which.

DESCRIPTION OF THE PREFERRED EMBODIMENT

In order to understand the full impact of the disclosed invention, it should be recognized that there are many kinds of foot deformities, some of which are inherited, which affect the ankle, leg, thighs and back.

Some of the abnormal foot changes can be generally classified as (1) the forefoot varus and valgus, (2) rearfoot valgus and (3) the heel varus.

Figure 1A:
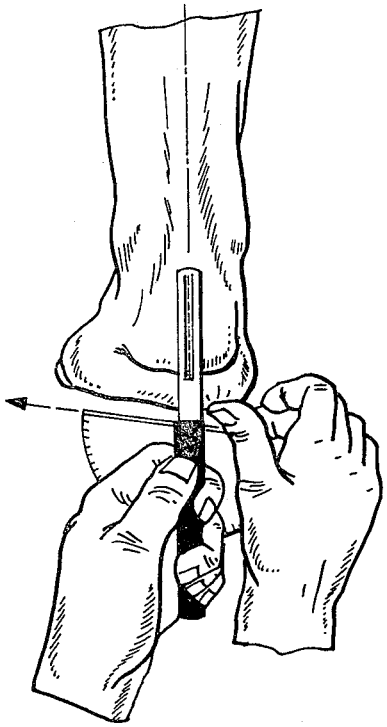
FIGS. 1A and 1B illustrate a position in which the forefoot is turned upward with the big toe higher than the fifth toe.
Figure 1B:
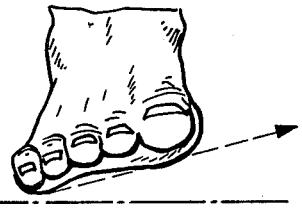

The forefoot varus as shown in FIG. 1A–1B is a position in which the forefoot is turned upward with the first toe (big toe) higher than the fifth toe creating an angle with a horizontal walking surface.

Figure 2A:
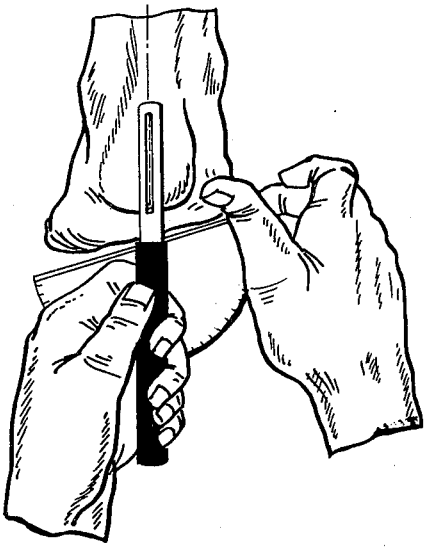
FIGS. 2A and 2B illustrate a condition similar to FIGS. 1A and 1B except the big toe is lower than the fifth toe.
Figure 2B:
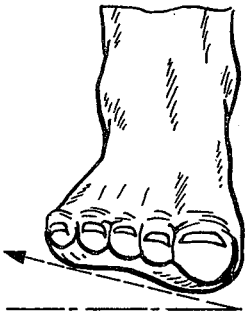

The forefoot valgus is a foot condition similar to the forefoot varus, shown in FIG. 2A–2B, except the first toe is lower than the other four toes, i.e., a reverse condition from the forefoot varus condition.

Figure 3:
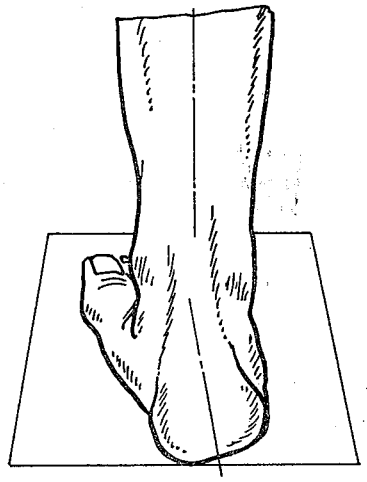
FIG. 3 illustrates a rearfoot heel valgus.

The rearfoot heel valgus shown in FIG. 3 is a condition wherein the heel turns out twisting the foot inward and is common in flat foot conditions.

Figure 4:
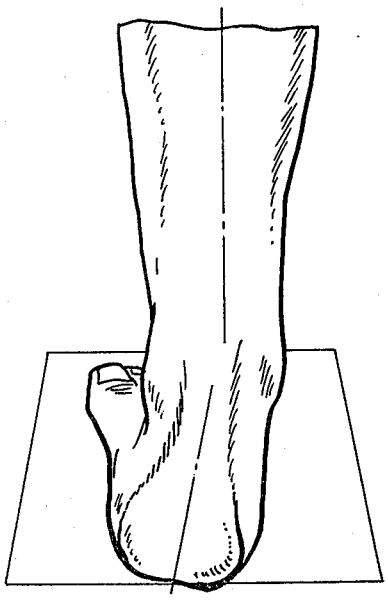
FIG. 4 illustrates a heel varus.

The heel varus shown in FIG. 4 is a condition wherein the heel is turned inwardly and is commonly seen in many people who have high arched feet.

Figure 5A:
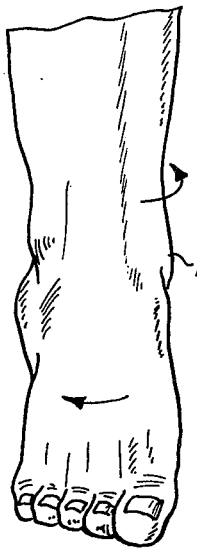
FIGS. 5A–5C illustrate various views of a flat foot condition.
Figure 5B:
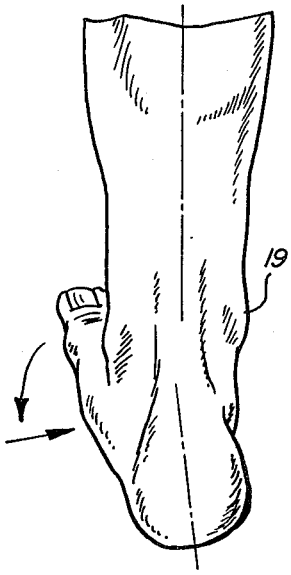
Figure 5C:
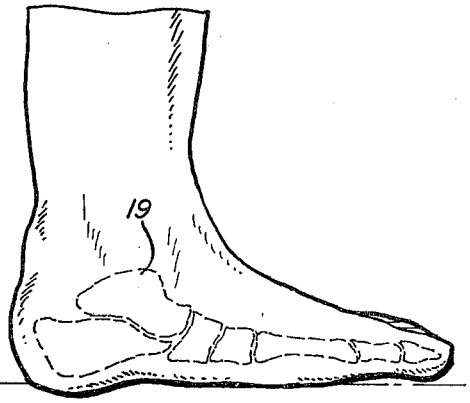

FIGS. 5A–5C illustrate various views of a flat foot condition which is a common foot disorder which affects the way people walk and the comfort of walking.

Figure 6:
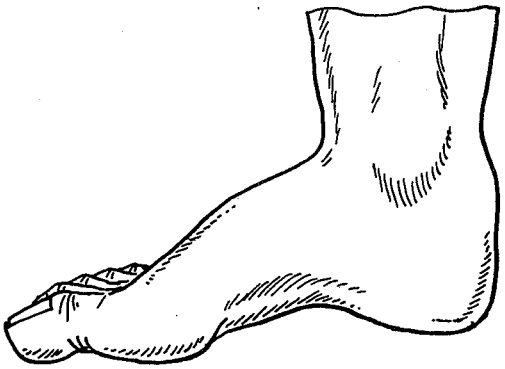
FIG. 6 illustrates a high arched foot.

FIG. 6 illustrates a high arched foot.

Variations of these conditions affect the heel and middle and front sections of the foot and affect the way we walk including the thirteen muscles of the leg of which twelve thereof are inserted in the foot.

Shoes such as the earth shoe and others have been modified to affect the posture of the foot and in turn the leg muscles and some have provided a recessed heel and a rocker bottom on the shoe to lower the heel and put strain on the calf muscles. This action in adults stretches the heel cord but puts undesired pressure on the bone structure, muscles and ligaments of the legs, thighs and back which have been set in a given position for years. Accordingly, the prior art shoes which are fixed in design configuration do not compensate for the dynamic changing conditions of the user and may create foot or back discomfort or problems.

Since it is desirable to compensate for foot deformities so as to control the posture of the individual, i.e., pelvis and spinal column, a need exists for footwear which can be easily modified or changed by the user by merely changing the insole of his shoe.

The heel may be inverted or everted and can be accomplished by the individual by adding to either side of the heel portion of the insole of the shoe. The angle of the forefoot can be changed by changing the angulation of insole of the footgear. The arch of the foot and its tread surface can be controlled by adding to or changing the elevation of the insole of the shoe.

Callous on the bottom of the feet, hammertoes, fallen arches, strains and any number of pathological foot conditions can be treated at will and the treatment conditions changed periodically to accommodate changes which naturally take place with any positioning of the foot. Most treatments can be accomplished by elevating or lowering part of the foot thereby transferring the weight and balance of the person on his foot structure by modifying the insole configuration of his shoe, thus accomodating for various foot deformities.

Figure 7:
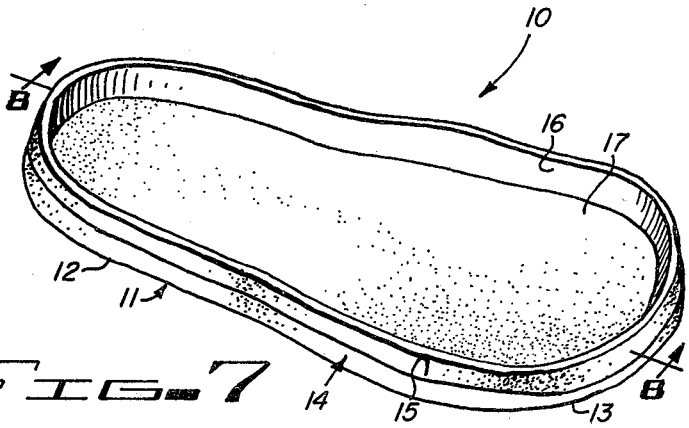
FIG. 7 is a perspective view of a sole for footwear and embodying the invention.
Figure 8:
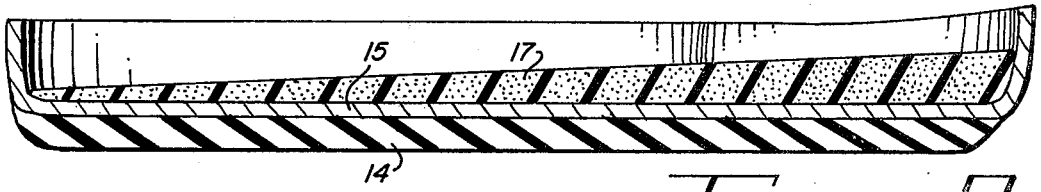
FIG. 8 is a cross-sectional view taken along the line 8—8 of FIG. 7.
Figure 9:
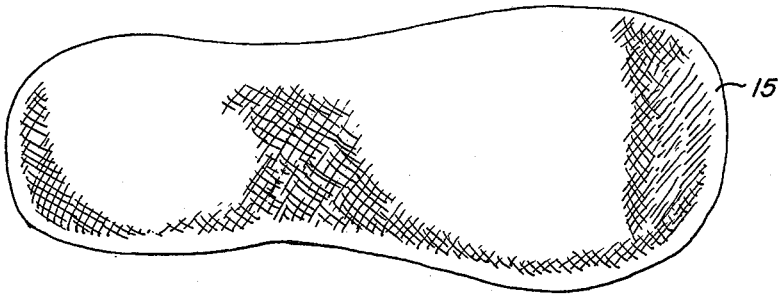
FIG. 9 is a bottom view of the sole of the footwear shown in FIG. 5.

FIGS. 7–9 disclose novel footwear 10 according to the teachings of the invention comprising a sole member 11 having a heel section or portion 12 and a front or toe section or portion 13. The portions 12 and 13 may or may not be arranged in the same plane with the toe portion 13 curved upwardly as shown in full lines or flat with the heel portion as shown in dash lines.

As shown in the drawings, the sole member extends clear to the rear of the shoe and there is no raised heel portion as in the usual shoe.

The sole comprises a ground bearing surface 14 having any suitable tread design and an upper bearing surface 15 each having identical shape across the width of the sole member symmetrical in plan form for use with either the right or left foot of the wearer and an insole or instep insert 17 mounted on the upper bearing or top surface 15 of the sole member 14. This insole is intended to vary in thickness and foot engaging surface design to provide the therapeutic benefits desired. The upper bearing surface of the sole member 14 is provided with a ridge 16 which extends outwardly of its upper bearing surface 15 around its periphery for receiving in its confining space insert or insole 17 which may be of any suitable resilient material.

The shoe may be constructed in its upper portion 18 much the same way as conventional shoes, if so desired; however, it should be understood that other suitable designs may be used. Each upper portion will provide the necessary ankle support and upstanding walls to support the ankle 19 of the wearer and to provide suitable ornamental show appearance of the wearer's foot, It is intended that the upper portion may be detachably connected to the sole member by any suitable means such as the Velcro fasteners 16' or other attaching means, part of which is formed along part or all of the outer periphery of ridge 16 of the sole member and part on the upper portion of the shoe. The dynamic changing of the insole with simultaneous use makes it possible to control the position of the foot and the leg angle at the ankle which affects the leg, knee and back condition of the wearer.

By using a modifiable or resilient insole, formed to control the foot, the wearer assumes a normal and comfortable walk by causing the foot to assume a better actual transfer of weight thereby preventing abnormal or unusual twisting of the leg and knee which creates excessive strain through fatigue, especially since modern man walks on inflexible surfaces.

The insole 17 design configuration comprising its thickness and angular characteristics can be readily modified as desired. Prior art shoes employing a given upper sole design configuration maintains the foot in one give position which causes the focusing of the stress and weight on one part of the foot only.

The disclosed insole permits the wearer to transfer his foot impressions or pattern at will for the most comfortable position dynamically changing as the wearer's foot changes. The modifiable or resilient insole 17 disclosed allows the wearer to shift his weight normally from the bottom or arched or ball area of the foot to the large toe by normal walking propulsion. Since no fixed angle is the same for all people wearing footwear because each part of the person's foot is a little different, no fixed footwear or pattern fully compensates for the walking or standing pattern of each one of us.

Figure 10:
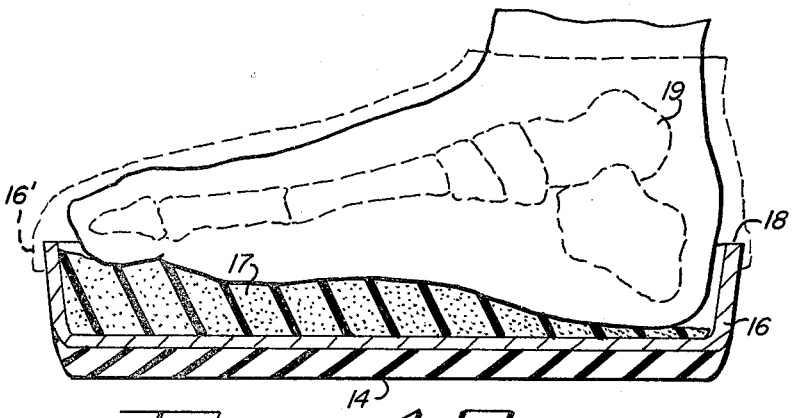
FIG. 10 is a cross-sectional side view of one position of an insole in use in footwear of the type shown in FIGS. 7–9 illustrating the foot skeleton support.

The disclosed insole 17 in combination with the other parts of the shoe permits more flexibility for existing foot deformities and thus more foot comfort. The sloping condition of the insole, as shown in FIGS. 8 and 10 wherein the upper bearing surface is inclined downwardly approximately 5° to 20° or any other angle desired from the toe portion to the heel portion with respect to the upper bearing surface of the sole member affects the leg and knee positions making it possible to overcome by gradual conditioning, existing leg and knee deformities by adjusting the transfer of weight to all parts of the bottom of the feet at will by the user of the disclosed footwear by merely modifying and changing the shape and form of the insole. The resiliency of the insole permits the foot to change its weight transfer as the conditions of the foot change momentarily, day, weekly, monthly or as the changes happen in the walking and standing efforts of the wearer.

Figure 11:
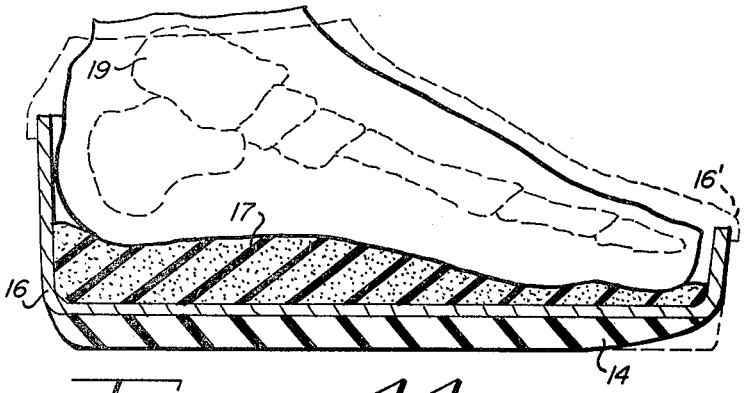
FIG. 11 illustrates a side view of a modification of the position of the insole shown in FIG. 10 with the heel of the foot elevated.

FIG. 11 illustrates a side view of a modification of the shape and position of the insole 17 shown in FIG. 10 wherein the upper bearing surface of the insole 17' is inclined downwardly approximately five to twenty degrees or any other desired angle from the heel portion to the toe portion thereby also affecting the leg and knee positions making it possible to overcome by gradual conditioning various existing leg, knee and foot deformities.

Figure 12:
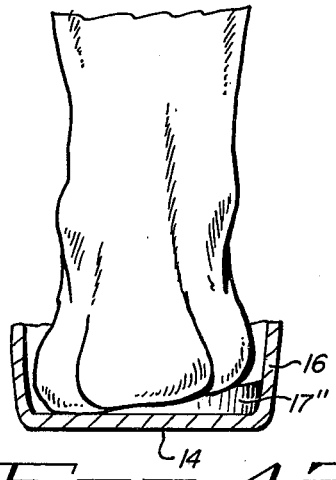
FIG. 12 is a cross sectional heel end view of the shoe structure shown in FIGS. 7–9 illustrating an insert for accomodating a heel valgus or varus condition.
Figure 13:
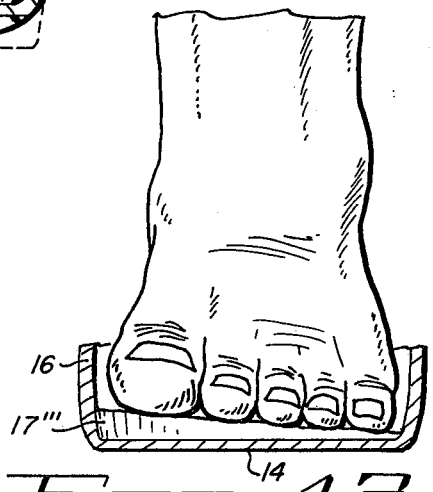
FIG. 13 is a cross-sectional front end view of the shoe structure shown in FIGS. 7–9 illustrating an insert for accomodating a forefoot varus or valgus condition.

FIGS. 12 and 13 illustrate heel and toe end views respectively, of the shoe structure shown in FIGS. 7–9 illustrating inserts 17'' and 17''' for accommodating various heel valgus or varus conditions.

As noted from FIGS. 12 and 13, the upper surfaces of the inserts are tapered from one side to the other to accommodate these foot conditions.

Since the disclosed shoe is intended to be built up by the wearer to fit his or her particular foot deformity, it must accommodate the conditions of either foot and varying shapes of the insert insole means.

For example, when pain along the arch of the foot occurs due to fallen arches, pulled heel cord due to a tight tendon, stretching of the strong fibers which hold up the arch or arthritis, the insert insole which may be of any suitable material such as foam rubber, air, water and styrofoam filled resilient bags, cottom wadding, felt or composition of matter or the like which may be shaped to form a wedge configuration so as to elevate the inside of the arch of the foot.

It should be noted that the midtarsal joint of the foot may compensate for any force due to irregularities in the terrain, which will invert the forefoot but the midtarsal joint cannot compensate for any force producing eversion of the forefoot. The eversion force must be compensated by subtalar joint pronation. The pronated position of the subtalar joint unlocks the midtarsal joint, allowing further eversion of the forefoot, if necessary. Since various eversions of the foot are not always possible with age, the dynamic insole of this invention compensates for what the human body cannot do.

Figure 14:
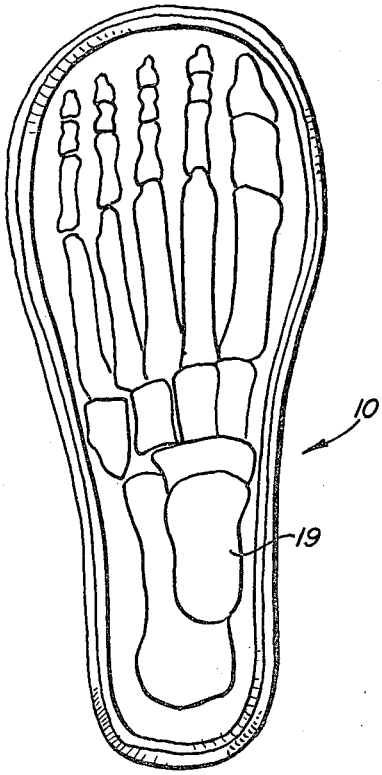
FIG. 14 illustrates a cross-sectional view of the shoe shown in FIGS. 7–9 with the skeleton of the foot in place illustrating that the shoe can accomodate either the right or left foot.

FIG. 14 illustrates a cross sectional view of the shoe shown in FIGS. 7–9 with the user's foot inserted in the shoe illustrating that the shoe can accomodate either the right or left foot.

Figure 15:
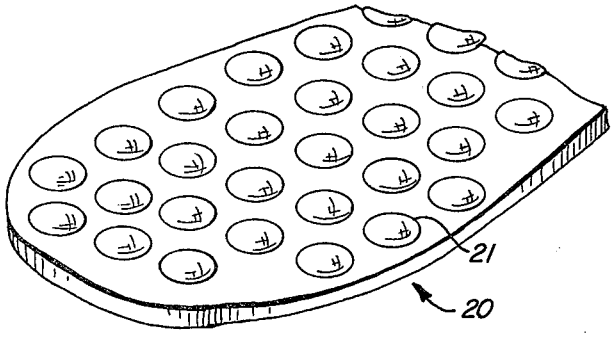
FIG. 15 is a partial perspective view of a modification of the insole shown in FIG. 8.

FIG. 15 discloses a modification of the insole configuration shown in FIGS. 7 and 9 wherein the insole 20 comprises a pad employing a plurality of air pockets 21 which provide a readily deformable lightweight easily changeable member.

Although but a few embodiments of the present invention have been illustrated and described, it will be apparent to those skilled in the art that various changes and modifications may be made therein without departing from the spirit of the invention or from the scope of the appended claims.

What is claimed is:

1. A therapeutic health shoe comprising:

a sole member having toe and heel portions adapted to be secured on the underside of either foot of a user, said sole member having an upper bearing surface and a ground bearing surface each having identical shape across the width of the sole member symmetric in plan form for use with either right or left foot of the wearer, said upper bearing surface of said sole member having a ridge extending outwardly of its upper bearing surface around its periphery for receiving within its confining space an insole, an insole of modifiable material of the same shape as the ground upper bearing surface of said sole member, said insole having an upper bearing surface which generally in its entirety is inclined downwardly approximating five to twenty degrees from either toe or heel portion to the other end of the shoe with respect to the upper bearing surface of said sole member and a lower bearing surface which is flat with respect to a horizontal supporting plane, said insole being of a resilient material which may be formed by the wearer to provide a contoured configuration to stretch the posterior leg muscles for maintaining a normal foot posture, said resilient material dynamically responding to the foot pressures of the wearer, an upstanding shoe portion for attaching to the sole member, and a Velcro fastener for attaching the upstanding shoe portion to the sole member, part of said Velcro fastener being detachably connected to the ridge of said upper bearing surface of said sole member and part on said upstanding shoe portion.

2. The therapeutic health shoe set forth in claim 1 wherein:

said ground bearing surface of said sole member is flat with the end of the toe portion tapered upwardly a given amount symmetrically across its width.

3. The therapeutic health shoe set forth in claim 1 wherein:

the lower bearing surface of said insole diverges transversely relative to its upper bearing surface in the heel portion of the shoe in a continuous single direction,

4. The therapeutic health shoe set forth in claim 1 wherein:

said sole member and its ridge are formed from a composition of matter.

5. The therapeutic health shoe set forth in claim 1 wherein:

the upper bearing surface of said insole is inclined downwardly approximately five to twenty degrees from one side to the other transversely of the longitudinal axis of the insole.

6. The therapeutic health shoe set forth in claim 1 wherein:

said insole formed of resilient material.

7. The therapeutic health shoe set forth in claim 1 wherein:

said ground bearing surface of said sole member is flat.

8. The therapeutic health shoe set forth in claim 1 wherein:

said ridge is detachably mounted on said sole member.

* * * * *